US006301740B1

(12) United States Patent
Quiroz

(10) Patent No.: US 6,301,740 B1
(45) Date of Patent: Oct. 16, 2001

(54) DISPOSABLE BRUSH

(76) Inventor: Humberto M. Quiroz, 16030 NE. 19 Pl. Apt. 2, North Miami, FL (US) 33162

( * ) Notice: Subject to any disclaimer, the term of this patent is extended or adjusted under 35 U.S.C. 154(b) by 0 days.

(21) Appl. No.: 09/507,353

(22) Filed: Feb. 18, 2000

(51) Int. Cl.[7] ..... A46B 15/00; A46B 7/04

(52) U.S. Cl. ..... 15/172; 15/144.1; 15/176.1

(58) Field of Search ..... 15/144.1, 144.2, 15/145, 146, 172, 176.1, 176.6, 202

(56) References Cited

U.S. PATENT DOCUMENTS

| | | | | |
|---|---|---|---|---|
| 8,911 | * | 4/1852 | Murrow | 15/145 X |
| 186,399 | * | 1/1877 | Landis | 15/144.1 X |
| 501,084 | * | 7/1893 | Landis | 15/144.1 X |
| 589,351 | * | 8/1897 | Humbach | 15/144.1 |
| 1,186,915 | * | 6/1916 | Landis | 15/144.1 X |
| 1,595,901 | * | 8/1926 | Mahler | 15/144.1 |
| 2,278,283 | * | 3/1942 | Raptis | 15/144.1 |
| 2,348,972 | * | 5/1944 | Gray | 15/172 |
| 2,395,245 | * | 2/1946 | Booharin | 15/144.2 |
| 2,581,141 | * | 1/1952 | Raptis | 15/144.2 |
| 2,680,032 | * | 6/1954 | McClenahan | 15/144.1 X |
| 3,412,043 | * | 11/1968 | Bertolina | 15/144.1 X |
| 3,737,187 | * | 6/1973 | Pryor | 15/144.1 X |
| 5,435,037 | | 7/1995 | Ledingham | 15/168 |
| 5,502,859 | * | 4/1996 | Kim | 15/144.1 |
| 5,802,658 | * | 9/1998 | Ward | 15/144.2 |
| 5,996,175 | * | 12/1999 | Fusco | 15/144.1 X |
| 6,016,586 | * | 1/2000 | Hsu | 15/144.1 |

FOREIGN PATENT DOCUMENTS

| | | | | |
|---|---|---|---|---|
| 482051 | * | 9/1929 | (DE) | 15/144.1 |
| 3004708 | * | 8/1980 | (DE) | 15/145 |
| 2624766 | * | 6/1989 | (FR) | 15/176.1 |
| 259402 | * | 6/1928 | (IT) | 15/145 |
| 58177 | * | 7/1937 | (NO) | 15/144.1 |

* cited by examiner

*Primary Examiner*—Mark Spisich
(74) *Attorney, Agent, or Firm*—J. Sanchelima

(57) ABSTRACT

A brush with a handle that includes a pivotally mounted female engagement member at one end of the handle. This end of the handle includes a fork termination with two separated elongated members that have each a flat opposing surface with radially disposed recesses therein. An elongated termination of the female engagement member cooperatively and snugly fits between the surfaces. The elongated termination includes cooperating ribs that permit a user to keep the female engagement member at a predetermined angle with respect to the handle. And the female engagement member is removably coupled to a mating male engagement member that includes a bristle gripping assembly. A user can then paint with the brush without causing the pivoting female engagement member to move by the strokes up to a predetermined magnitude.

3 Claims, 2 Drawing Sheets

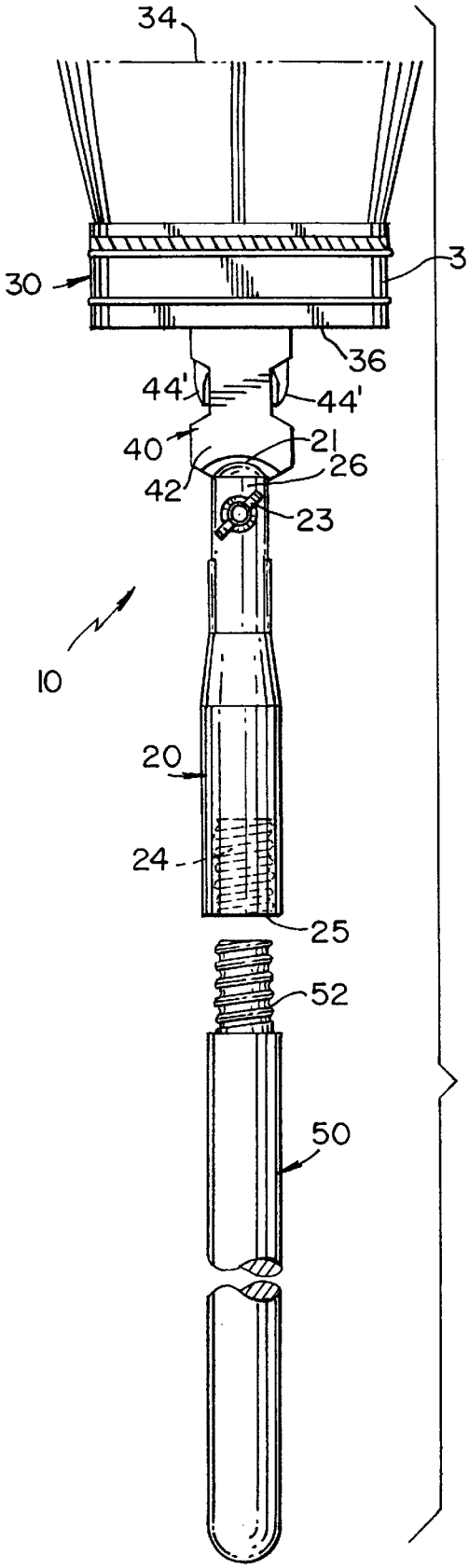
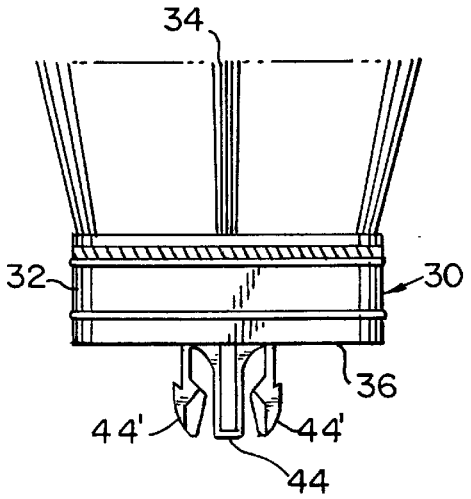
FIG - 2 -
FIG - 1 -

DISPOSABLE BRUSH

BACKGROUND OF THE INVENTION

1. Field of the Invention

The present invention relates to a paint brush, and more particularly, to the type that includes a replaceable bristle cartridge assembly and a pivotally mounted handle.

2. Description of the Related Art

Applicant believes that the closest reference corresponds to U.S. Pat. No. 5,435,037 issued to Ledingham in 1995. However, it differs from the present invention because Ledingham' patent does not teach a brush that has a handle with a buckle assembly that permits a user to readily replace the bristle cartridge assembly with another one with different dimensions.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a paint brush that includes a buckle assembly to implement the releasably engagement of one end of the handle to the bristle assembly so that a user can readily exchange the bristle assembly depending on the job being performed.

It is another object of this invention to provide a paint brush that includes a handle pivotally mounted to the buckle so that the latter and thus the bristle cartridge assembly can be rotated and adjusted in a predetermined number of angles with respect to the axis of the handle, depending on the needs of the job or desires of the user.

It is still another object of the present invention to provide a paint brush that includes such a handle that permits a user to adapt an extension at the end of the handle in order to have access at high places.

It is yet another object of this invention to provide such a paint brush that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 1 is a top view of a paint brush showing a handle extension in exploted.

FIG. 2 is a top view of a bristle cartridge assembly with a male engaging buckle member built-in.

DETAILED DESCRIPTION OF THE PREFERRED EMBODIMENT

Figure 3:
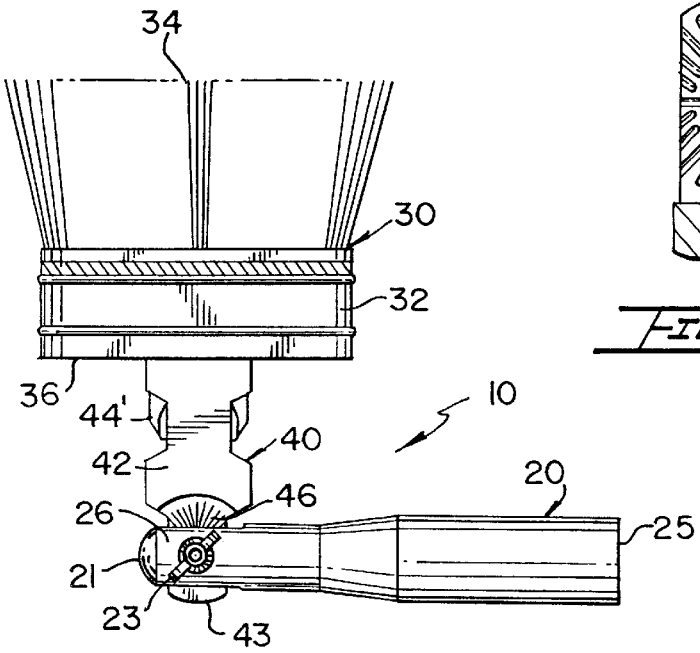
FIG. 3 is a top view of this invention showing the handle rotated in 90 degrees with respect to bristle cartridge assemble and buckle assembly.

Referring now to the drawings, where the present invention is generally referred to with numeral 10, it can be observed that it basically includes handle member 20 that is removably mounted to bristle cartridge assembly 30 through buckle assembly 40.

Handle member 20, in the preferred embodiment, is pivotally mounted, at end 21, to buckle assembly 40 with wing screw 23. Handle member 20 includes also threaded cavity 24 located at end 25. Cavity 24 is designed to cooperatively receive threaded end 52 of extension rod 50. This permits a user to have access to high areas without the need of a stepladder.

Bristle cartridge assembly 30 includes ferrule 32 supporting bristles 34. Bristle cartridge assembly 30, in the preferred embodiment, has shoulder 36 with male engaging member 44 of buckle assembly 40 rigidly mounted thereto. Member 44 includes resilient outer members 44' that are cammingly pressed inwardly when brought inside female engaging member 42.

Figure 5A:
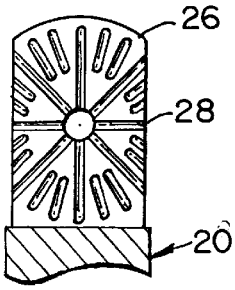
FIG. 5A is a bottom view of the fork showing several elongated recesses for cooperatively receiving shown ribs, taken along line 5A—5A.
Figure 4:
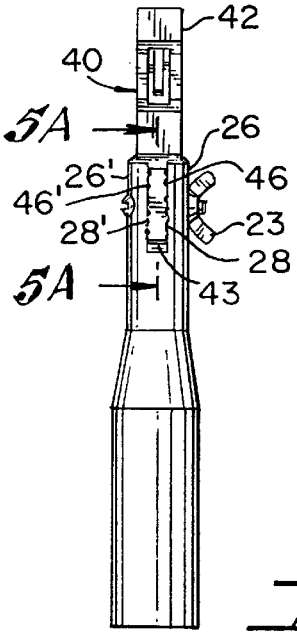
FIG. 4 is an elevational side view of the handle and buckle assembly coaxially aligned.
Figure 5:
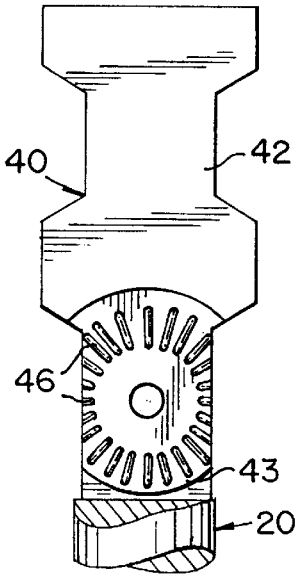
FIG. 5 is a top view of the buckle assembly showing several ribs coaxially disposed and a partial view of the handle.

Buckle assembly 40 basically includes female engaging member 42 and male engaging member 44. Buckle assembly 40 is provided to implement the releasably engagement of end 21 of handle assembly 20 to bristle assembly 30 so that a user can readily change the latter depending on the job being performed. The preferred buckle assembly 40 is of the quick-connect type that is conventionally available, as seen in FIGS. 1 through 5. Female engaging member 42 of buckle assembly 40, as shown in FIGS. 3; 4 and 5, includes buckle portion or elongated termination 43. Buckle portion 43 is pivotally sandwiched within fork members 26 and 26' that are located at end 21 of handle member 20. Buckle portion 43 is kept in place with respect to end 21 by wing screw 23 and recesses 28; 28' and ribs 46. Buckle portion 43 includes ribs 46 and 46' that are radially disposed in its outer opposite surfaces and co-act with recesses 28 and 28' of fork members 26 and 26', respectively, as shown in FIG. 4. Recesses 28 and 28' are radially disposed in the inner opposite surfaces of fork members 26 and 26', respectively, as best seen in FIG. 5A. In this manner, handle member 20 encounters a resistance to any pivotal force applied by a user.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A brush, comprising:

A) handle means having first and second ends, said first end including two fork members defining a gap therebetween, each fork member including a bore therein, inner facing surfaces including a plurality of recesses extending radially from the respective bores;

B) a buckle assembly having third and fourth ends, said third end including a projection having opposite facing surfaces, each of the surfaces including a plurality of ribs radially extending from a bore in the projection, the projection adapted to be received in said gap, and said fourth end includes a female connector member that includes a housing with opposite slots;

C) fastening means for bringing said inner facing surfaces of the fork members towards each other thereby securing said projection in place; and D) a bristle assembly including a gripping female and a plurality of bristle members held by said gripping female, and said bristle assembly further includes a male connector member having two parallel and spaced apart resilient outer members having cooperative dimensions for releasably engaging in said slots.

2. The brush set forth in claim 1 wherein the first end of the handle means and the third end of the buckle assembly define adjustment means for setting said buckle assembly at a number of predetermined angular positions with respect to the axis of said handle means.

3. The brush set forth in claim 2 wherein said fastening means includes a wing screw.

* * * * *